US008405951B2

(12) United States Patent
Schwiebert et al.

(10) Patent No.: US 8,405,951 B2
(45) Date of Patent: Mar. 26, 2013

(54) CLEANING MECHANISM WITH TANDEM MOVEMENT OVER EMITTER AND COLLECTOR SURFACES

(75) Inventors: Matthew Schwiebert, San Jose, CA (US); Nels Jewell-Larsen, San Jose, CA (US); Kenneth Honer, Santa Clara, CA (US)

(73) Assignee: Tessera, Inc., San Jose, CA (US)

( * ) Notice: Subject to any disclaimer, the term of this patent is extended or adjusted under 35 U.S.C. 154(b) by 388 days.

(21) Appl. No.: 12/820,009

(22) Filed: Jun. 21, 2010

(65) Prior Publication Data

US 2011/0308768 A1 Dec. 22, 2011

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS

| | | | | |
|---|---|---|---|---|
| 4,689,056 | A * | 8/1987 | Noguchi et al. | 96/79 |
| 6,855,190 | B1 | 2/2005 | Nikkhah | |
| 6,893,618 | B2 * | 5/2005 | Kotlyar et al. | 422/186.04 |
| 7,150,780 | B2 * | 12/2006 | Krichtafovitch et al. | 96/72 |
| 2003/0170150 | A1 | 9/2003 | Lau | |
| 2004/0065202 | A1 | 4/2004 | Gatchell | |
| 2010/0033891 | A1 | 2/2010 | Orihara | |

FOREIGN PATENT DOCUMENTS

| | | | |
|---|---|---|---|
| GB | 1090444 | A | 11/1967 |
| GB | 1519542 | A | 8/1978 |
| JP | 2001058139 | A | 3/2001 |
| WO | 2009134663 | A1 | 11/2009 |

OTHER PUBLICATIONS

Jewell-Larsen. "Electrohydrodynamic (EHD) cooled laptop." Semiconductor Termal Measurement and Management Symposium, 2009. Semi-Therm 2009. 25th Annual IEEE, Piscataway, NJ, Mar. 15, 2009. pp. 261-266.

* cited by examiner

*Primary Examiner* — Stephen W Jackson
(74) *Attorney, Agent, or Firm* — Zagorin O'Brien Graham LLP

(57) ABSTRACT

An apparatus for tandem cleaning of an emitter electrode and collector electrode in electrohydrodynamic fluid accelerator and precipitator devices via movement of a cleaning mechanism including respective cleaning surfaces positioned to frictionally engage the emitter electrode and collector electrode. The cleaning mechanism causes the respective cleaning surfaces to travel along a longitudinal extent of the emitter electrode and, in tandem, over a major dimension of the collector electrode to remove detrimental material from respective electrode surfaces. Alternatively, the electrodes can be transited in tandem in frictional engagement with a fixed cleaning mechanism in the same or opposite directions. A conditioning material is optionally deposited on an electrode to at least partially mitigate ozone, erosion, corrosion, oxidation, or dendrite formation on the electrodes. The conditioning material can include an ozone reducer.

23 Claims, 8 Drawing Sheets

CLEANING MECHANISM WITH TANDEM MOVEMENT OVER EMITTER AND COLLECTOR SURFACES

BACKGROUND

Technical Field

This application relates generally to cleaning of electrodes in electrohydrodynamic or electrostatic devices such as electrohydrodynamic (EHD) fluid accelerators and electrostatic precipitators (ESP).

Many electronic devices and mechanically operated devices require air flow to help cool certain operating systems by convection. Cooling helps prevent device overheating and improves long term reliability. It is known to provide cooling air flow with the use of fans or other similar moving mechanical devices; however, such devices generally have limited operating lifetimes, produce noise or vibration, consume power or suffer from other design problems.

The use of an ion flow air mover device, such as an electrohydrodynamic (EHD) device or electro-fluid dynamic (EFD) device, may result in improved cooling efficiency, and reduced vibrations, power consumption, electronic device temperatures, and noise generation. This may reduce overall device lifetime costs, device size or volume, and may improve electronic device performance or user experience.

In many EFA or EHD devices and other similar devices, detrimental material such as silica dendrites, surface contaminants, particulate or other debris may accumulate or form on electrode surfaces and may decrease the performance, efficiency and lifetime of such devices. In particular, siloxane vapor breaks down in a plasma or corona environment and forms solid deposits of silica on the electrode, e.g., emitter or collector electrodes. Other[s] detrimental materials may build up on any number of electrode surfaces. Build-up of such detrimental materials can decrease power efficiency, cause sparking or reduce spark-over voltage and contribute to device failure.

Accordingly, improvements are sought in cleaning and conditioning electrode surfaces.

SUMMARY

Devices built using the principle of the ionic movement of a fluid are variously referred to in the literature as ionic wind machines, electric wind machines, corona wind pumps, electro-fluid-dynamics (EFD) devices, electrohydrodynamic (EHD) thrusters and EHD gas pumps. Some aspects of the technology have also been exploited in devices referred to as electrostatic air cleaners or electrostatic precipitators.

In the present application, implementations of the devices illustrated and described herein are referred to as electrohydrodynamic fluid accelerator devices, and are suitable for use as a component in a thermal management solution to dissipate heat generated by an electronic circuit, amongst other things. Some implementations are described in the context of an electrostatic precipitator device.

It has been discovered that it is possible to clean emitter electrodes and collector electrodes in electrohydrodynamic fluid accelerator and electrostatic precipitator devices or other ion flow devices, via movement of a cleaning mechanism in frictional engagement with the emitter electrode and in tandem with the collector electrode.

In some implementations, an apparatus includes an electrohydrodynamic fluid accelerator and an emitter electrode in spaced relation to one or more collector electrode surfaces, each of the emitter electrode and collector electrode surfaces susceptible to accumulation of detrimental material during operation of the electrohydrodynamic fluid accelerator. The apparatus includes a cleaning mechanism with respective cleaning surfaces positioned to frictionally engage the emitter electrode and at least a portion of the collector electrode surfaces. The cleaning mechanism is operable to cause the respective cleaning surfaces thereof to travel along a longitudinal extent of the emitter electrode and, in tandem, over a major dimension of the collector electrode surfaces to thereby remove detrimental material from respective electrode surfaces.

In some cases, the emitter electrode and the collector electrode surfaces together at least partially define the electrohydrodynamic fluid accelerator. For example, emitter electrode and the collector electrode surfaces can be positioned relative to one another such that, when energized, ions are generated therebetween and fluid flow is thereby motivated along a fluid flow path.

In some cases, at least one additional electrode surface is disposed either upstream or downstream of the electrohydrodynamic fluid accelerator along the fluid flow path, and the cleaning mechanism includes at least one further cleaning surface to travel over a major dimension of the additional electrode, and in tandem, along a longitudinal extent of the emitter electrode.

In some implementations, both the emitter electrode and the collector electrode surfaces are operable as part of the electrohydrodynamic fluid accelerator.

In some implementations, the electrohydrodynamic fluid accelerator includes the emitter electrode and is energizable to motivate fluid flow along a fluid flow path, and the collector electrode surfaces are disposed upstream of the electrohydrodynamic fluid accelerator along the fluid flow path and are operable as part of an electrostatic precipitator.

In some cases, the emitter electrode and the collector electrode surfaces are operable as part of an electrostatic precipitator.

Thus, the cleaning mechanism may be employed to clean, in tandem, electrodes operable in each of an electrohydrodynamic fluid accelerator and an electrostatic precipitator.

In some cases, the emitter electrode is operable as part of one of the electrohydrodynamic fluid accelerator and an electrostatic precipitator, and wherein the collector electrode surfaces are operable as part of the other of the electrohydrodynamic fluid accelerator and the electrostatic precipitator.

In some cases, a second emitter electrode is operable as part of an electrostatic precipitator and the cleaning mechanism includes a respective cleaning surface to frictionally engage the second emitter electrode. The cleaning mechanism is operable to travel in tandem along a longitudinal extent of both the first and the second emitter electrodes.

In some implementations, the apparatus includes a secondary cleaning device positioned to frictionally engage a cleaning mechanism surface to remove detrimental material accumulated thereon.

In some implementations, the cleaning mechanism further serves to condition a respective electrode. In some cases, a respective cleaning surface in frictional engagement with the emitter electrode includes an electrode conditioning material depositable on the electrode via movement of the cleaning mechanism. In some cases, the electrode conditioning material comprises a wearable carbon material. In some cases, the conditioning material includes an ozone reducer, e.g., catalyst, activated charcoal, or other material combinable with ozone.

In some implementations, an apparatus includes an electrostatic precipitator and an emitter electrode in spaced relation to one or more collector electrodes, each of the emitter electrode and collector electrode susceptible to dendrite formation or other accumulation of detrimental material on a surface thereof during operation of the electrostatic precipitator. A cleaning mechanism including respective cleaning surfaces is positioned to frictionally engage at least a portion of the respective emitter electrode and collector electrode surfaces. The cleaning mechanism is operable to cause the respective cleaning surfaces to travel along a longitudinal extent of the emitter electrode and, in tandem, over a major dimension of a collector electrode surface to thereby remove detrimental material.

In some cases, the emitter electrode is operable as part of the electrostatic precipitator and the one or more collector electrodes are operable as part of an electrohydrodynamic fluid accelerator.

In some cases, the emitter electrode is operable as part of an electrohydrodynamic fluid accelerator and the one or more collector electrodes are operable as part of the electrostatic precipitator.

In some implementations, the apparatus includes a controller operable to initiate movement of one of the cleaning mechanism to thereby remove detrimental material from the electrode surfaces in response to one of detection of an event, detection of arcing between the electrodes, and a change in measured device operating parameters.

In some cases, the controller is responsive to detection of an event, e.g., powering on, and a change in measured device operating parameters, e.g., electrode arcing. In some cases, the cleaning mechanism operates when the electrode is powered off.

In some cases, movement of the cleaning mechanism also causes an electrode conditioning material to be deposited in situ on the electrodes, e.g., via wearing of a substantially solid bulk of conditioner material disposed on the cleaning mechanism. In some cases, the conditioning material is depositable via one of a wearable layer, wearable pad, and wearable insert disposed on the cleaning mechanism.

In some implementations one or more electrodes or electrode surfaces are conditioned during tandem movement of the cleaning surfaces to inhibit contamination buildup and facilitate removal of detrimental material. In some cases the conditioning material provides low adhesion properties to the conditioned electrode surface. In some cases, a carbon bearing cleaning surface serves to both remove detrimental materials built up on the electrode and to further deposit a carbon coating or other conditioning material on the electrode to reduce adhesion and facilitate subsequent detrimental material removal. Periodic or repeated conditioning can reduce or prevent gradual buildup of detrimental materials or oxidation of the electrode.

In some implementations the conditioning material provides resistance to oxidation and other effects of the plasma environment or ion bombardment and may also lubricate the electrode to prevent damage to a surface metal coating during cleaning. The metal coating and carbon conditioning coating can protect underlying electrode metals from ion bombardment and plasma erosion.

In some implementations, the conditioning material includes an ozone reducer. In some cases, the conditioning material is selected to at least partially mitigate at least one of electrode erosion, corrosion, oxidation, silica adhesion, dendrite formation or mechanical adhesion of other detrimental material. In some cases, the conditioning material includes at least one of silver, palladium, platinum, manganese, nickel, zirconium, titanium, tungsten, aluminum, oxides or alloys thereof, carbon, and organometallic materials that decompose under plasma conditions.

In some implementations, the cleaning mechanism contacts a single surface, side or portion of a respective electrode. For example, a cleaning surface may extend from the cleaning mechanism adjacent one side of an electrode. The cleaning surface may be positioned to engage a portion of the electrode most prone to dendrite formation, detrimental material accumulation or erosion, e.g., a leading electrode edge in an air flow.

In some implementations, the cleaning mechanism contacts multiple respective electrode surfaces, e.g., obverse surfaces of an electrode. In some cases, multiple cleaning surfaces extend from the cleaning mechanism to contact multiple surfaces of a respective electrode.

In some cases, a cleaning surface defines a substantially nonlinear profile to thereby deflect the electrode during movement of the cleaning mechanism along the electrode.

In some cases, the respective electrodes include an emitter electrode and a collector electrode. In some cases, additional electrodes may be cleaned and/or conditioned in tandem via movement of the cleaning mechanism. For example, any number of additional collector electrodes, grounding electrodes, precipitator electrodes, backflow electrodes, repelling electrodes and the like may be cleaned or conditioned in tandem with movement of the cleaning mechanism along the emitter electrode.

Similarly, additional device structures including air fluid filters, cooling surfaces and the like may also be cleaned by cleaning surfaces of the cleaning mechanism in tandem with movement of the cleaning mechanism along the emitter electrode.

In some implementations, an EFA, EHD or similar ion flow device is incorporated into an electronic apparatus including a controller operable to initiate movement of the cleaning mechanism to thereby clean the respective electrodes and/or to deposit the conditioning material on a respective electrode. In some cases, the cleaning and conditioning are performed by the same cleaning mechanism surfaces.

In some cases, a respective cleaning surface comprises a brush, squeegee, scraper or wiper. In various implementations, a brush may be a rotating brush. In some cases, a cleaning surface includes a compliant or conformal surface such as a squeegee or wiper blade.

In some cases, a brush, wiper or other cleaning surface may be made of a soft material such as a polymer to prevent abrasion of the electrode. In a particular case, a cleaning surface includes a bristled brush comprising Nylon or other dielectric material. The dielectric brush is positioned to engage respective collector electrode surfaces and to move over the electrode surfaces in tandem with movement of the cleaning mechanism along a respective emitter electrode.

In some implementations, the cleaning mechanism includes multiple sets of complementary cleaning surfaces frictionally engaging opposite sides of respective electrodes. The cleaning mechanism may transport any number of additional cleaning surfaces in tandem with movement of respective cleaning surfaces along a longitudinal extend of an emitter or collector electrode. For example, a first additional cleaning surface may be provided in the form of a bristle brush in contact with a backflow electrode, cooling fins, or air flow filter substantially aligned in spaced relation with the emitter and/or collector electrode.

In some cases, respective cleaning surface include wearable pads selected to condition a respective electrode surface, e.g., via deposition of a carbon coating, ozone reducer or other conditioning material.

Thus, the cleaning mechanism may transit in tandem any number and type of cleaning surfaces in contact with any combination of respective electrode surfaces and associated EFA or EHD structures to thereby effect cleaning and/or conditioning thereof.

In some applications, the present invention features a method of cleaning an emitter electrode in tandem with a collector electrode, each of the emitter electrode and collector electrode being susceptible to accumulation of detrimental material on respective surfaces thereof during operation. The method includes transiting a first cleaning surface of a cleaning mechanism in frictional engagement along a longitudinal extent of the emitter electrode; and transiting, in tandem, a second cleaning surface of the cleaning mechanism in frictional engagement over a major dimension of a collector electrode surface to thereby remove detrimental material.

In some applications, the method includes depositing, in situ, an electrode conditioning material on at least one of the emitter electrode and the collector electrode surface via travel of the cleaning mechanism.

In some applications, the method includes depositing, in situ, an electrode conditioning material on the electrode. In some cases, the electrode conditioning material includes an ozone reducer. In some cases, the deposited conditioning material forms a sacrificial coating selected to mitigate electrode oxidation in a plasma, corona discharge or ion bombardment environment. In some implementations, the conditioning material is deposited by movement of the cleaning surface of the cleaning mechanism along the electrode.

The use of an electrohydrodynamic device may result in reduced vibrations, electronic device temperatures, and noise generation relative to conventional mechanical air cooling systems such as fans. In some cases, EFA or EHD device efficiency may be affected by dendrite formation and other detrimental material that may cause voltage changes, electrical arcing, and loss of power in air flow efficiency. Cleaning the electrode, such as an emitter or collector electrode, may reduce these problems, improve lifetime operating costs, and improve efficiency.

The detailed description refers to the accompanying drawings that show, by way of illustration, specific aspects and implementations in which the present disclosed teaching may be practiced. Other arrangements and implementations may also be utilized, and structural, logical, and electrical changes may be made without departing from the scope of the disclosed implementations. The various implementations are not necessarily mutually exclusive, as some implementations can be combined with one or more other implementations to form new implementations.

BRIEF DESCRIPTION OF THE DRAWINGS

Various implementations are described in detail below with reference to the following drawings.

DETAILED DESCRIPTION

Figure 1A:
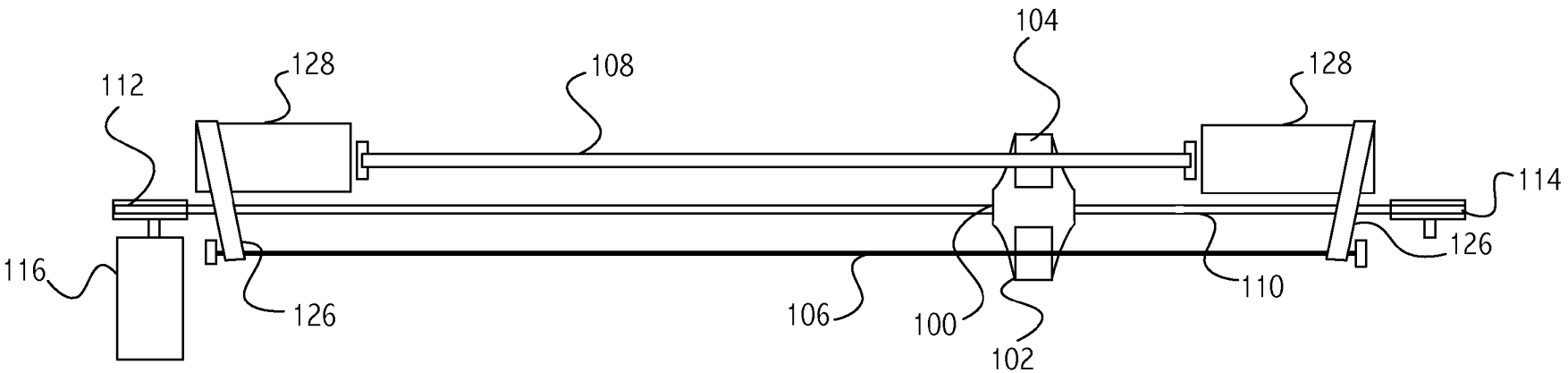
FIGS. 1*a*-1*b* illustrate a cleaning mechanism including a drive mechanism for transiting cleaning surfaces of the cleaning mechanism in tandem along electrodes, in accordance with various implementations.
Figure 1B:
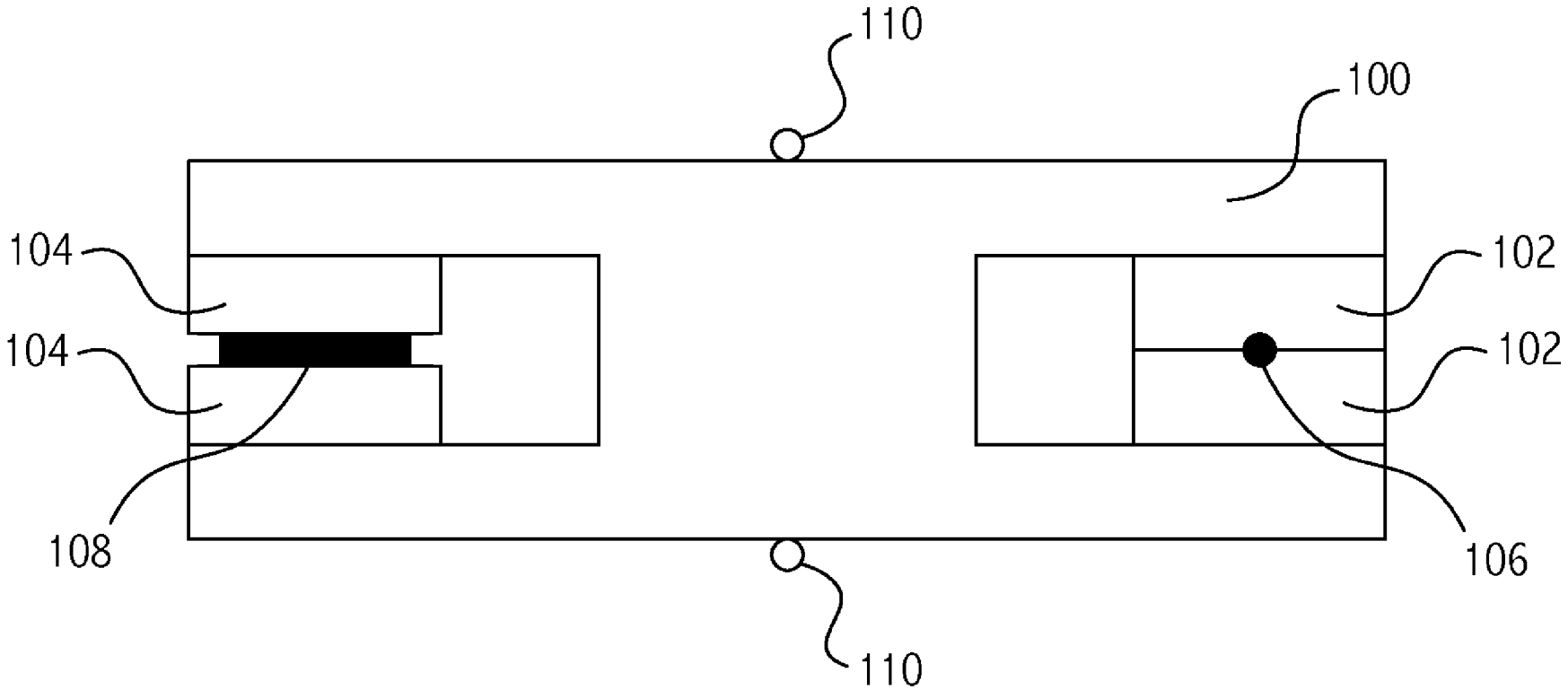

With reference to FIGS. 1*a*-1*b*, a cleaning mechanism 100 includes respective cleaning surfaces 102 and 104 positioned to frictionally engage at least a portion of a respective emitter electrode 106 and collector electrode 108. Cleaning mechanism 100 is moveable to cause respective cleaning surfaces 102 and 104 to travel in tandem along the respective surfaces of emitter electrode 106 and collector electrode 108 to thereby remove detrimental material such as silica dendrites, surface contaminants, particulate or other debris from the respective electrode surfaces. Cleaning surfaces 102 and 104 can be employed to remove dendrites or other detrimental material from electrodes 106 and 108 or to otherwise clean or condition the electrodes.

Emitter electrode 106 and collector electrode 108 are positioned relative to one another and energizable to generate ions to motivate fluid flow along a fluid flow path. Thus, emitter electrode 106 and collector electrode 108 may at least partially define an electrohydrodynamic fluid accelerator. Any number of additional electrodes may be positioned upstream and downstream of the electrohydrodynamic fluid accelerator along the fluid flow path. Additional cleaning surfaces can be provided to frictionally engage and travel over surfaces of the additional electrodes in tandem with travel of cleaning surfaces 102 and 104 along a longitudinal extent of emitter electrode 106.

In some implementations, a collector electrode 108 can be disposed upstream of the electrohydrodynamic fluid accelerator along the fluid flow path and can operate as an electrostatic precipitator.

While electrodes 106 and 108 are generally depicted as elongated or wire-type emitter and collector electrodes, any combination of electrode types and electrode surfaces may be cleaned in tandem via cleaning surfaces 102 and 104 via movement of cleaning mechanism 100.

For example, a first respective cleaning surface 102 may travel along a longitudinal extent of emitter electrode 106 and a second respective cleaning surface, e.g., cleaning surface 104, travels in tandem over a major dimension of a surface of collector electrode 108 or other electrode. For example, an ESP or EHD device can include grounding electrodes, repelling electrodes, backflow electrodes or other electrodes arranged to motivate air through the device to exhaust heat delivered, e.g., from a heat sink via a heat pipe.

In the illustrated implementation, cleaning mechanism 100 includes multiple cleaning surface pairs 102 and 104 positioned to clean opposite surfaces of respective electrodes 106 and 108. Cleaning surfaces 102, 104 can be contoured to clean all or part of a respective electrode. For example, cleaning surfaces 102 can provide substantially complete circumferential contact with emitter electrode 106 via grooves formed in cleaning surfaces 102. While electrodes 106 and 108 are generally referred to as emitter and collector electrodes respectively, cleaning mechanism 100 may be used to clean any combination of two or more electrodes, e.g., 106 and 108.

Additionally, cleaning mechanism 100 may be fitted with additional cleaning surfaces to be transited past any number of electrodes, filters, or other system features prone to detrimental material accumulation and in need of mechanical cleaning or other surface conditioning.

Cleaning mechanism 100 can be driven or translated via a drive cable 110 trained about a drive pulley 112 and idler pulley 114, with drive pulley 112 being rotatable by a drive motor 116. Other types of drive mechanisms may be used to move cleaning mechanism 100 to thereby clean and/or condition an electrode.

Alternatively, in some implementations, electrodes 106 and 108 may be driven in tandem past cleaning mechanism 100. For example, electrodes 106 and/or 108 may be trained about drive pulleys, similar to drive cable 110. Electrodes 106 and 108 may be in the form or elongated wires or bands and may be transited in the same or opposite directions past cleaning mechanism 100 by respective drive pulleys or other drive mechanisms. In a particular implementation, an elongated ribbon-like electrode is twisted to form a mobius strip. A mobius strip electrode configuration can be advantageous for cleaning opposed surfaces of an electrode with a single cleaning surface. Thus, in some implementations, tandem cleaning of two electrodes may be performed by movement of the electrodes in the same or opposite direction past respective cleaning surfaces of a cleaning mechanism.

Cleaning mechanism 100 may be movable in single passes such that cleaning mechanism 100 moves between alternate ends of electrodes 106 and 108 in each cycle. Alternatively, cleaning mechanism 100 may reciprocate or move bidirectionally in a single cycle or it in may perform any number of movements at any desired speed in a given cycle. In some implementations, cleaning operations may be repeated, extended, or tailored to achieve a desired degree of cleaning as determined by testing performance characteristics between cleaning cycles. For example, after a first cleaning cycle, an emitter electrode can be energized and various performance characteristics measured, e.g., voltage, current, sparking, and the like. Additional cleaning cycles may then be initiated as needed and additional performance checks conducted to determine sufficiency of electrode cleaning.

With continued reference to FIGS. 1*a*-1*b*, dendrite material or other detrimental material may accumulate on the exterior of cleaning mechanism 100, e.g. adjacent cleaning surfaces 102 or 104 during cleaning and conditioning of electrodes 106 and 108. Accordingly, a secondary cleaning device, e.g., brush 126, is positioned near an end of the travel path of cleaning mechanism 100 to remove accumulated detrimental material from cleaning mechanism 100. Brush 126 is positioned to contact the cleaning mechanism exterior, e.g., leading edges or surfaces adjacent cleaning surfaces 102 and 104 where detrimental material dislodged from electrodes 106 or 108 may accumulate on cleaning mechanism 100. Thus, secondary detrimental material accumulation may be removed from cleaning mechanism 100 including cleaning surfaces 102 and 104 by brush 126 or other suitable secondary cleaning device.

In some implementations, cleaning surfaces 102 or 104 can include a brush and the secondary cleaning device 126 can include a rigid structure positioned to deflect and release bristles of the brush to dislodge secondary detrimental material therefrom. Accordingly, any number or type of secondary cleaning devices may be used with respective cleaning surfaces 102 or 104, or other portions of cleaning mechanism 100 to remove secondary detrimental material therefrom.

In the particular illustrated implementation, brush 126 is positioned along an end portion of the path of travel of cleaning mechanism 100 and such that advancement of cleaning mechanism 100 against brush 126 causes brush 126 to deflect and to thereby wipe across the affected area of cleaning mechanism 100.

The detrimental material dislodged by brush 126 can be accumulated in a receptacle area 128 positioned adjacent a stowed position where the cleaning mechanism 100 resides between cleaning cycles. Passages (not shown) in a sidewall or floor portion of receptacle area 128 can be provided to allow escape of the dislodged detrimental material from the system, for example, upon tipping of the system during transport. Still in some implementations, passages are provided below the electrode wire such that dislodged detrimental material simply falls out of the electronic device, e.g., as a fine powder through vents in a lower surface. In some cases, receptacle area 128 may include a removable detrimental material bin.

In some implementations, electrodes 106 and/or 108 are elongated wire electrodes that are placed in tension and the cleaning mechanism 100 defines respective cleaning surfaces 102 and 104 contoured or otherwise shaped to contact a desired portion of electrodes 106 and 108. For example, in some cases, cleaning surfaces substantially conform to a profile or shape of a surface of a respective electrode 106 or 108. Thus, a grooved cleaning surface may receive an elongated electrode to travel along a longitudinal extent or surface thereof. Similarly, a substantially planar cleaning surface may be transited over a substantially planar major portion of a respective electrode. In some cases, the electrode is substantially rigid and the cleaning surface conforms to the electrode. In other cases, the electrode may conform somewhat to the cleaning surface, for example, in the case of a wire electrode and a contoured cleaning surface.

In some implementations, the respective opposed cleaning surfaces are urged against one another or against the respective electrode by an applied force. In a particular case, elongated electrode wires are positioned in spaced relation, e.g., 1-5 mm and energizable to establish a corona discharge therebetween. The electrodes are placed in tension, e.g., 10-30 g, and are cleaned using grooved carbon cleaning surfaces, with a 40-80 g preload between the cleaning surfaces and the respective electrode. The carbon bearing cleaning surfaces are transited in tandem along the respective electrodes at about 13 mm/s in both an initial pass and a return pass. The carbon present on the cleaning surfaces preferably has a hardness selected to effectively remove detrimental material from the electrode while not abrading the electrode material or electrode surface coating. In some cases, the carbon is sufficiently soft to wear and deposit a carbon coating on the electrode. Carbon is but one example of a conditioning material that may be present on cleaning surfaces 102 and 104. Other conditioning materials may be used, e.g., to provide ozone reducing coatings, sacrificial coatings, electrode surface refinishing, electrode lubrication, or other useful conditioning of electrodes.

In various elongated electrode implementations, varying degrees of electrode tension and cleaning speeds may be employed. For example, cleaning surfaces having a softer wiper surface, e.g., felt or bristled brushes, may employ a higher electrode preload, e.g., 350 g. An applied force may be provided between a cleaning surface and an electrode or between cleaning surface counterparts by springs, compressible foam, magnetic repulsion, fringing fields, solenoids, electrical repulsion, or any other means of providing a selected contact force. For example, elastic deformation of a tensioned electrode may serve to provide the applied force.

Sufficient dendrites can form on the emitter electrode to potentially affect the performance of the electrode in a relatively short period of operation, 2-4 hours under extreme conditions. Accordingly, cleaning may be advantageously initiated as a function of time, detection of dendrite growth, or in response to various events, e.g., power cycles or electrode arcing.

With reference to FIG. 1*b*, one implementation of a cleaning mechanism 100 includes electrode 106 and 108 and respective cleaning surfaces 102 and 104 in frictional engagement with respective electrodes 106 and 108. As shown, cleaning mechanism 100 can be positioned substantially between electrodes 106 and 108 with members extending therefrom to position cleaning surfaces 102 and 104 in contact with respective electrodes 106 and 108.

In some implementations, cleaning surfaces 102 and/or 104 include wearable, replaceable inserts retained on cleaning mechanism 100. Cleaning surfaces 102 and 104 are each depicted as including two counterpart inserts. The inserts may be retained by adhesion, fasteners, interference fit or other suitable means. In some implementations, the respective opposed inserts may be urged against one another or against the respective electrode by a spring, foam block, via elastic deformation of a retaining portion of the cleaning mechanism or the like.

Cleaning surfaces 102 and 104 may be periodically replaced as needed. For example, counterparts of cleaning surfaces 102 or 104 may be initially spaced a distance apart and may eventually contact due to wearing of the cleaning surfaces through extended cleaning use. Thus, contact of the cleaning surface counterparts may be used, for example, to indicate an end of the life for the respective cleaning surface. In some cases, operation of the cleaning mechanism 100 may result in the removal of some of the cleaning surface material resulting in a groove forming or deepening in the cleaning surface.

Cleaning surfaces 102 and 104 may extend beyond electrodes 102 and 104, may be coextensive with an electrode dimension, or may extend only over a portion of the electrode to clean a desired portion thereof. While each of cleaning surfaces 102 and 104 are depicted as including mating opposed counterparts on opposite surfaces of a respective electrode, it will be understood that the invention is not limited to two part cleaning mechanisms for use with wire electrodes as shown in the figure, but may include single piece cleaning mechanisms such as shuttles, beads, brushes, or multiple cleaning heads and surfaces for use with planar electrodes, elongated electrodes and other shaped electrodes. Thus, cleaning mechanism 100 may be moved in contact with electrodes 106 and 108 to remove detrimental material from respective electrode surfaces with single or multiple passes or other movement of cleaning mechanism 100.

While electrodes 106 and 108 are depicted as being generally parallel and the path of travel of cleaning mechanism as being generally linear, in some implementations, cleaning surfaces 102 and 104 may travel in tandem over divergent paths. For example, one or both of electrodes 106 and 108 may be subject to both longitudinal and orthogonal cleaning movements, such that respective travel of cleaning surfaces 102 and 104 may be in tandem yet not necessarily in parallel. Stated otherwise, cleaning surfaces 102 and 104 may travel in tandem at substantially the same longitudinal speed while traveling different paths having varying path vectors and varying total path lengths. For example, in some implementations, one cleaning surface may travel an undulating or otherwise substantially non-linear path while another travels a substantially linear path.

In some implementations, orthogonal or lateral travel of cleaning surface 102 serves to laterally deform electrode 106 as cleaning mechanism 100 travels a longitudinal extent of electrode 106 to further break up deposits of detrimental materials accumulated thereon. This lateral deformation can be in addition to other electrode deformation introduced in other directions, e.g., via a cleaning surface profile as described later with regard to FIGS. 4-7. In some cases, an elongated electrode may be bent or otherwise deformed in a first direction while being pulled or deformed in a second direction. Thus, an electrode may be subject to bending or deformation about two or more orthogonal axes.

In some implementations, cleaning block 102 is not fully aligned with electrode 106 but may be inclined, rolled or partially rotated relative to electrode 106. Such angular positioning of cleaning block 102 combined with lateral tensioning or lateral movement of electrode 106 by cleaning block 102 can cause electrode 106 to travel at least partially laterally across the face of cleaning block 102. Introduction of a lateral component to movement of electrode 106 across cleaning block 102 can provide more even wear of cleaning block 102 over time and reduce formation of grooves typical of aligned longitudinal travel. Thus, in some cases, the cleaning blocks can be oriented at different angles than those illustrated, e.g., vertically, and can be angularly positionable or moveable about any number of axes of the cleaning block body to contact the electrode in a selected manner.

Figure 2:
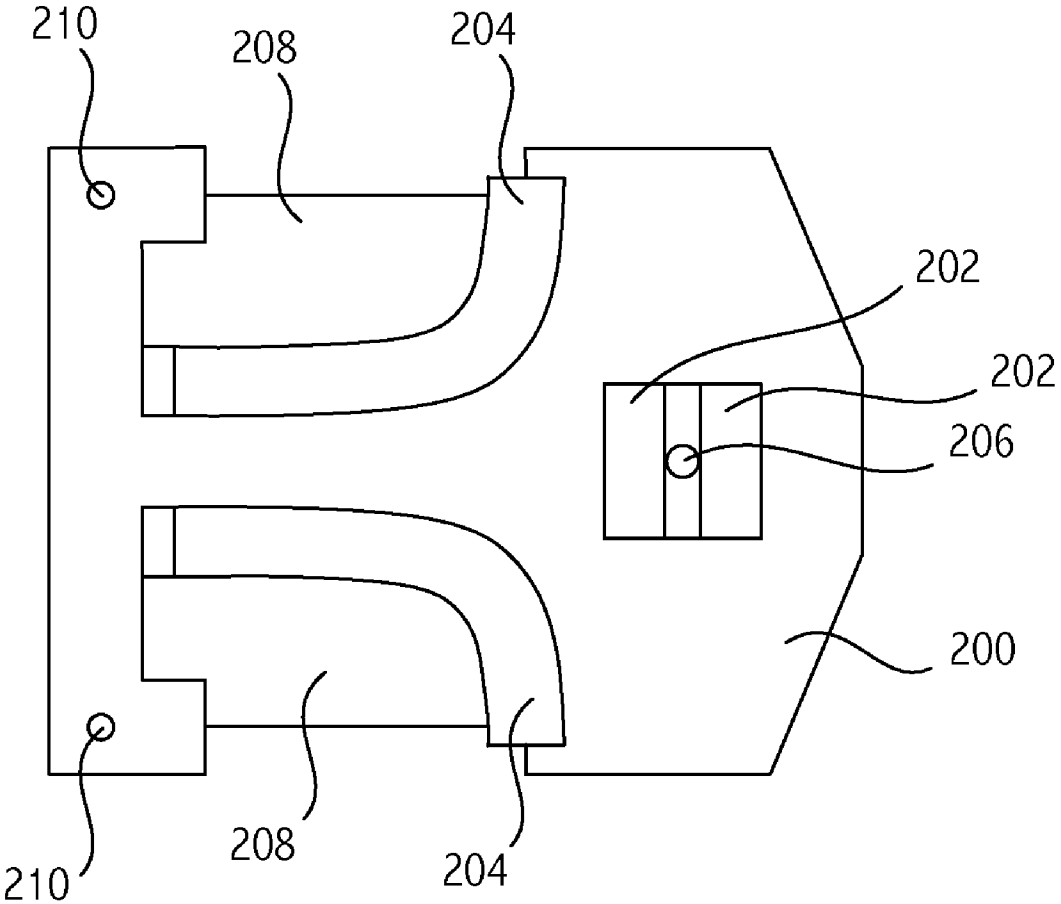
FIG. 2 depicts a side view of a cleaning mechanism, in accordance with various implementations.

With reference to FIG. 2, a drive cable 210 or other suitable driving structure may be positioned to the outside of the electrodes, substantially outside the flow path, rather than between the electrodes as in FIGS. 1*a*-1*b*. For example, in some implementations, drive cable 210 is positioned to the far side or outside of electrodes 208 such that cleaning mechanism 200 extends from drive cable 210 between electrodes 208 and past electrodes 208 to electrode 206. Such positioning of drive belt or drive cable 210 further from electrode 206 can reduce charging and sparking to drive cable 210 from the electric field around electrode 206 and can also help avoid interference with the electric field around the electrode 206.

In some implementations, electrode 208 can serve as a guide for movement and alignment of cleaning mechanism 200. In some cases, cleaning mechanism 200 can be slidingly retained on electrode 208. For example, cleaning mechanism 200 can extend between electrodes 208 from the rear to the front of electrodes 208 with cleaning surfaces 204 retained thereby adjacent respective surfaces of electrodes 208. Cleaning surfaces 202 are shown positioned on either side of electrode 206 in a vertical orientation.

Figure 3:
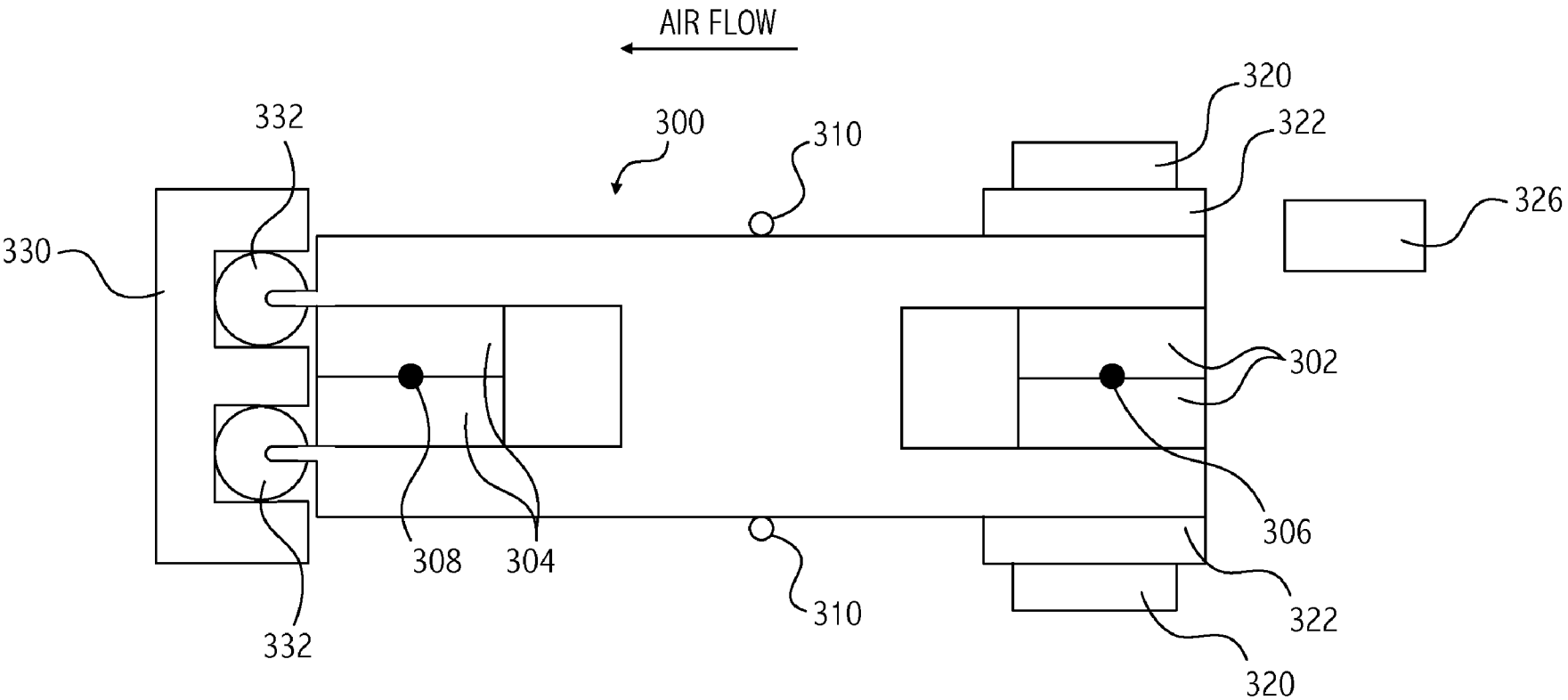
FIG. 3 illustrates a side view of a cleaning mechanism including additional cleaning surfaces in contact with additional electrodes, in accordance with various implementations.

With reference to FIG. 3, a cleaning mechanism 300 includes respective cleaning surfaces 302 and 304 in frictional engagement with surfaces of electrodes 306 and 308. Cleaning mechanism 300 is driven via drive cable 310 or other suitable drive mechanism, e.g., screw gear and worm gear, operable to move cleaning mechanism 300 and cause the respective cleaning surfaces 302 and 304 to travel in tandem along the respective electrodes 306 and 308 to thereby remove detrimental material from the respective electrode surfaces.

The emitter electrode 308 and collector electrode surfaces 330 are positioned relative to one another such that, when energized, an ion flow, e.g., a plasma discharge, is established therebetween and fluid flow is motivated along a fluid flow path. In some implementations, the emitter electrode 308 and collector electrode 330 at least partially define an electrohydrodynamic fluid accelerator.

In some implementations, additional electrode surfaces 320 are disposed upstream or downstream of the electrohydrodynamic fluid accelerator along the fluid flow path. In some implementations, additional electrodes may operate as an electrostatic precipitator. For example, with continued reference to FIG. 3, a collector electrode 320 is provided in spaced parallel relation to emitter electrode 306 and in contact with a pad 322, e.g., a felt or mohair pad, disposed on cleaning mechanism 300. Pad 322 can serve to clean grounding electrode 320 in tandem with movement of cleaning mechanism 300 along electrodes 306 and 308. Likewise, a backflow electrode 326 is spaced in substantially parallel relation to electrode 306. Cleaning mechanism 300 can include additional cleaning surfaces such as bristles of brush extending from a surface of cleaning mechanism 300 to contact electrode 326. Backflow electrode 326 can be positioned and charged to prevent ion backflow or ion movement counter to the direction of fluid flow.

Cleaning mechanism 300 is not limited to tandem cleaning of electrodes 306, 308, 320 or 330, but may further serve to clean additional device components or structures. For example, cooling fins, fluid filter or other non-electrode component may be positioned in spaced relation to any of the electrodes or cleaning mechanism 300 such that a bristled brush extending from cleaning mechanism 300 engages and travels along a portion or surface of component in tandem with movement of cleaning surfaces 302 and 304 along respective electrodes 306 and 308. Thus any number or combination of electrodes, electrode surfaces, non-electrode components, or any portions thereof, may be cleaned or otherwise conditioned via tandem movement of surfaces or extensions of cleaning mechanism 300 across any combination thereof.

In some cases, a respective cleaning surface frictionally engages and travels over a major dimension of a respective electrode. In some cases, a respective cleaning surface travels along a longitudinal extent of an electrode.

Figure 4:
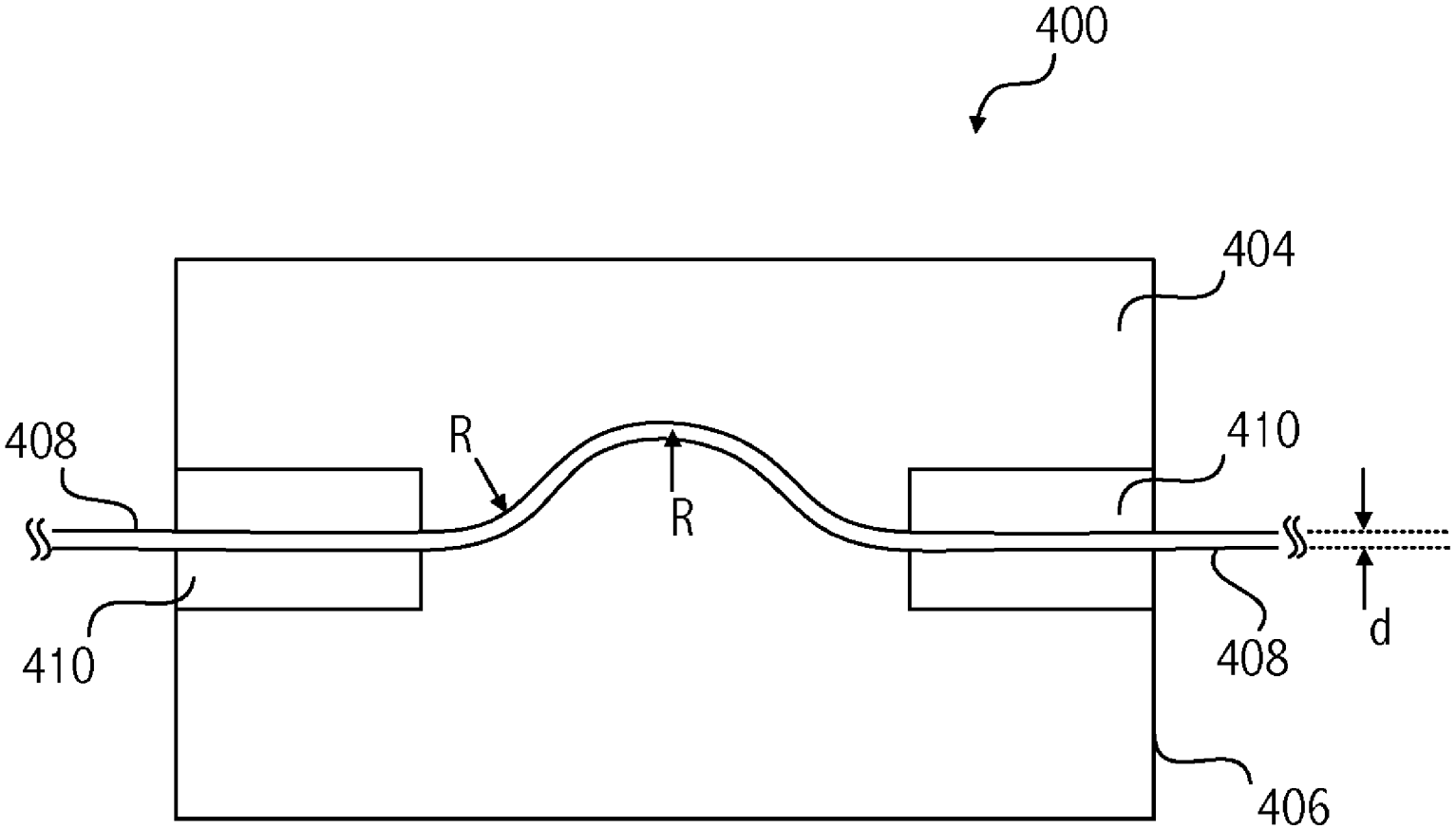
FIG. 4 illustrates an end on view of a cleaning mechanism including wearable conditioning material inserts in contact with an elongated emitter electrode, in accordance with various implementations.

With reference to FIG. 4, cleaning mechanism 400 includes cleaning surfaces 404 and 406 in frictional contact with electrode 408 along a central curved portion. Conditioning material inserts 410 are positioned at outward leading and trailing edges of cleaning mechanism 400 for conditioning electrode 408. This arrangement of conditioning material inserts 410 can be advantageous, for example, in depositing a lubricating conditioning material, e.g., graphite, prior to deflection and frictional cleaning of electrode 408 along the curved central portion of cleaning surfaces 404.

While conditioning material inserts 410 and cleaning surfaces 404 are illustrated as distinct elements, in some implementations, all or a major portion of cleaning surfaces 404 and 406 may comprise a conditioning material. For example, the whole of cleaning surfaces 404 and 406 can comprise a substantially solid bulk or block of carbon conditioning material. Thus, in various implementations, the conditioning material may be provided in addition to discrete cleaning surfaces or may form the cleaning surface itself.

With reference to FIGS. 5-9, the cleaning blocks can be constructed or arranged to elastically deform or deflect the electrode during cleaning, for example, via a nonlinear contour of a cleaning/conditioning block or of an electrode guide or other suitable electrode contact feature. In some implementations, the electrode is clamped between two conditioning pads/cleaning blocks, each of which define complementary surfaces for deflecting the electrode into a controlled bend. The radius of the bend is selected to avoid plastic deformation of the electrode. For example, the electrode diameter and bend radius are selected such that a ratio of the electrode radius to a bend radius does not exceed the yield strain of the electrode material. The complementary surfaces can include multiple undulations inducing controlled bending stress in the electrode to break up brittle silica deposits on the electrode. Deflection of the electrode also helps maintain contact between the electrode and the conditioning pads/cleaning blocks as they wear.

Figure 6:
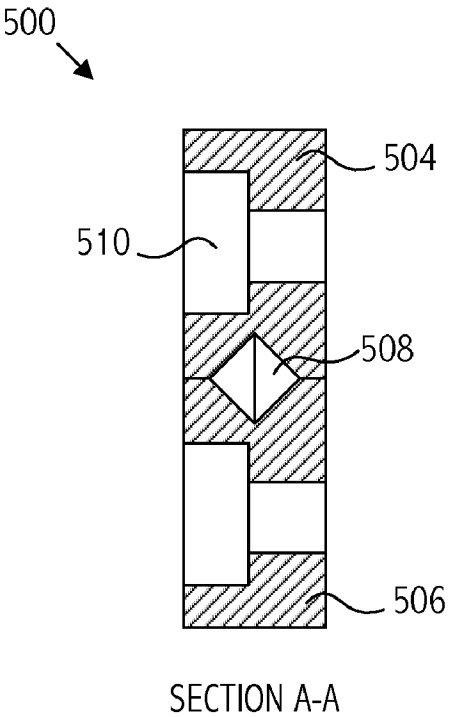
FIG. 6 illustrates a cross-sectional view of the cleaning surfaces of FIG. 5.
Figure 5:
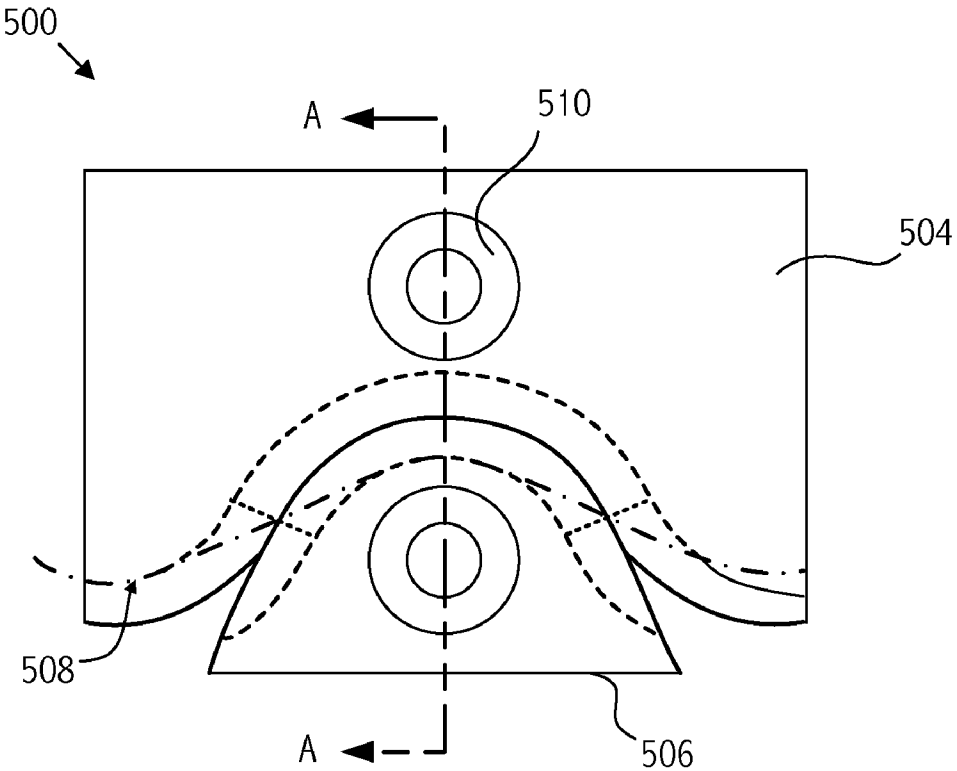
FIG. 5 illustrates a cleaning mechanism attachment including curved cleaning surface for deflecting an elongated emitter electrode, in accordance with various implementations.

With reference to FIG. 5 and the cross-sectional view of FIG. 6, a mechanical cleaning mechanism attachment 500 includes first and second opposed cleaning blocks 504 and 506 defining the cleaning surfaces for frictionally contacting an electrode. Cleaning blocks 504 and 506 together define a nonlinear electrode guide 508 or path providing for elastic deformation of an electrode and frictional cleaning contact on obverse electrode surfaces. During cleaning and conditioning, an electrode passes through electrode guide 508 as the cleaning blocks 504 and 506 are transited via the cleaning mechanism past the electrode. Electrode guide 508 is depicted in cross-sectional view as defining a channel sized to receive an electrode therein.

In some instances, elastic deformation of the electrode can increase cleaning or conditioning efficacy or control. For example, a degree of deformation of the electrode or a degree of friction at certain points of contact may be controlled to vary cleaning and conditioning parameters. Tension in the electrode or pressure or spacing between cleaning blocks 504 and 506 may be variable in some cases. For example, cleaning blocks 504 and 506 may initially be spaced a distance apart and may gradually move closer together and eventually contact one another following wear from extended cleaning and conditioning cycles.

Cleaning blocks 504 and 506 may be formed of a wearable material including a conditioning material composed to reduce adhesion, reduce ozone, or mitigate adverse affects of an ion bombardment or plasma environment, such as oxidation. For example, silver oxide may serve both to as a sacrificial coating and to reduce ozone.

In a particular implementation, cleaning blocks 504 and 506 are formed of a substantially sold, wearable graphite conditioning material. In some implementations, the wearable conditioning material is substantially softer than the electrode plating to avoid plating damage during cleaning/conditioning. In some cases, conditioning material compositions can include carbon, silver, platinum, manganese, palladium, nickel, or oxides or alloys of the same. In some cases, the condition material composition includes carbon, organometallic materials that decompose under plasma conditions or ion bombardment, and combinations thereof.

In some implementations, the conditioning material may be selected to have an ozone reduction function, e.g., to reduce the amount of ozone generated by the device. As an illustrative example, a material that includes silver (Ag) may be used to reduce ozone production and may also be used to prevent or reduce silica growth.

In some implementations, the conditioning material can provide a sacrificial layer or protective coating. Such a coating need not be continuous over the entirety of the operating surface of an electrode. In some cases, the coating may provide low adhesion or a "non stick" surface, or it may have a surface property that repels silica, which is a common material in dendrite formation. As an illustrative example, the conditioning material may include carbon such as graphite, and may have low adhesion to dendrite formation and other detrimental material, and may improve the ease of mechanically removing such detrimental material.

In some cases, a conditioning material may serve as a sacrificial layer that is oxidized or eroded by the plasma environment or by ion bombardment. Replenishment of this sacrificial layer via movement of the cleaning mechanism along a longitudinal extent of the electrode provides protection for the underlying electrode metal, such as tungsten, or another electrode protective coating that may otherwise be eroded or thinned.

In some implementations, blocks 504/506 are formed of different materials or include different conditioning materials. For example, one block may bear a felt or mohair cleaning material while the other block includes a wearable graphite conditioning material. In some implementations, cleaning blocks 504/506 both include harder carbon wiping and conditioning materials. In some implementations, at least one of cleaning blocks 504/506 includes a softer wiper material, e.g., a felt pad.

Cleaning blocks 504 and 506 are depicted as defining apertures 510 for receiving fasteners to attach blocks 504 and 506 to a movable cleaning mechanism. For example, block 506 may be attached as a fixture to a movable carriage as in FIG. 1 for transiting cleaning blocks 504 and 506 relative to the electrode.

With reference to FIG. 6, cleaning blocks 504 and 506 are shown in contact along edge portions thereof. In some implementations, cleaning blocks 504 and 506 may be in contact on one or both sides of the electrode during cleaning/conditioning operations. Alternatively, contact between the cleaning blocks may be used to indicate an end of life state for worn cleaning blocks in some implementations.

Cleaning blocks 504/506 may be moveable or otherwise variable between discrete cleaning and conditioning positions. Alternatively, cleaning blocks 504/506 can be fixed and provide for simultaneous cleaning and conditioning operations in single or multiple passes.

Figure 7:
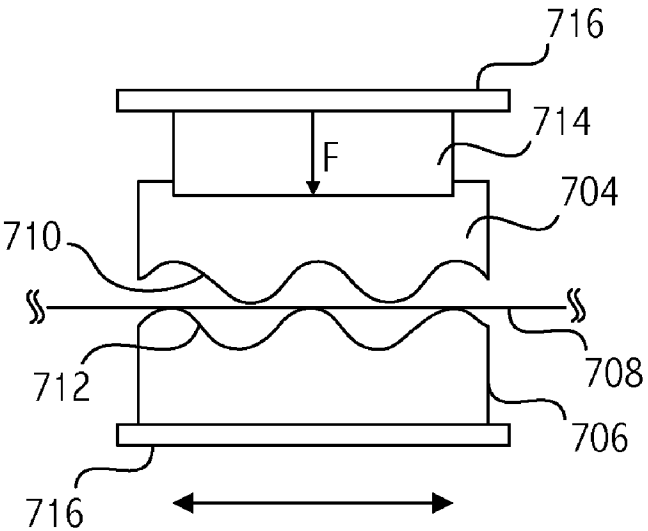
FIG. 7 illustrates an end on view of a cleaning mechanism including profiled cleaning surface for deflecting and cleaning an elongated emitter electrode, in accordance with various implementations.

With reference to FIG. 7, cleaning mechanism members 716 extend towards a respective electrode and bear respective complementary cleaning blocks 704 and 706, which are held in contact with electrode 708 via an applied force F. Applied force F can be provided by a compressed foam block 714, spring, elastic flexure or other mechanism disposed between at least one of the cleaning blocks 704/706 and a corresponding support structure, e.g., cleaning mechanism member 716. Cleaning blocks 704 and foam block 714 are arranged to provide pressure between cleaning block 704 and electrode 708 sufficient to frictionally clean electrode 708, which can also be deflected thereby for cleaning and conditioning.

Figure 8:
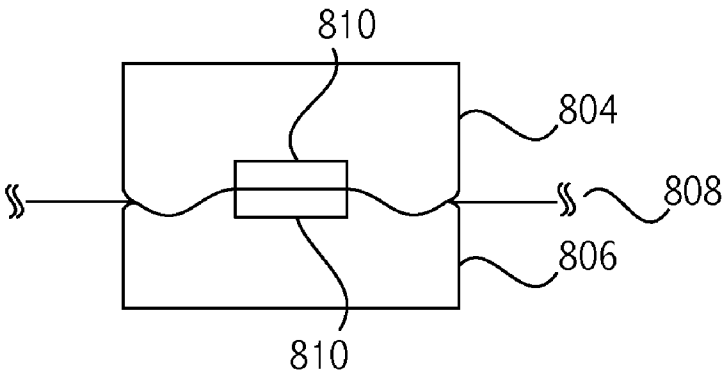
FIG. 8 illustrates an end on view of a cleaning mechanism including wearable conditioning material inserts in contact with an elongated emitter electrode, in accordance with various implementations.

With reference to FIG. 8, cleaning blocks 804 and 806 include a conditioning material insert 810 for conditioning an electrode 808. Conditioning material inserts 804 and 806 are centrally positioned on cleaning blocks 804 and 806, such that cleaning is performed primarily at the corresponding leading edge cleaning surfaces of cleaning blocks 804/806 and conditioning is performed as the electrode 808 passes over conditioning material inserts 810.

Conditioning material inserts 810 may be removable and replaceable as needed, or may be integral with and replaceable with cleaning blocks 804/806 as needed. Conditioning material inserts 810 can include similar or different conditioning material compositions. For example, one conditioning material composition can provide an electrode shielding composition to protect against oxidation, and another conditioning material composition can include an ozone reducer.

In some implementations, the cleaning blocks can include multiple cleaning or conditioning regions or surfaces. In some cases, the cleaning blocks each include at least a first region for removing dendrites from the electrode through scraping or frictional cleaning, and at least a second region for depositing a conditioning material coating on the electrode. In some cases, the cleaning and conditioning are simultaneously performed by movement of the cleaning mechanism. The cleaning blocks may include any combination of surface profiles, including flat, curved, grooved, undulating, and the like to provide a desired degree of frictional contact and/or electrode deflection during cleaning. The electrodes may be formed as a wire, bar, array, block, strip, or other form and the cleaning mechanism can be constructed to contact any desired portion of surfaces of the electrodes for tandem cleaning thereof.

Figure 9:
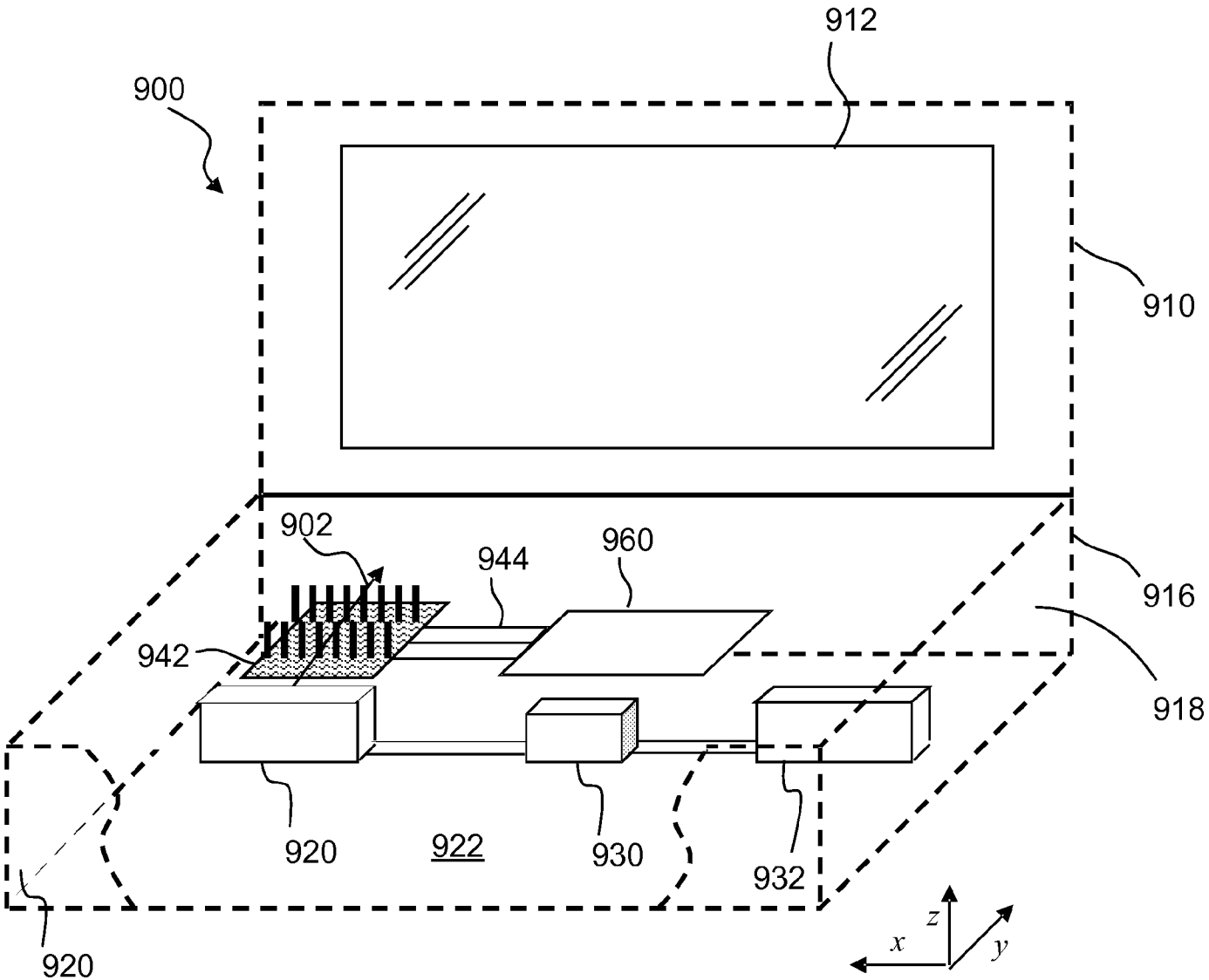
FIG. 9 depicts an electronic system using various implementations as described herein.

FIG. 9 is a schematic block diagram illustrating one implementation of an environment in which cleaning mechanism may operate. An electronic device 900 such as a computer includes an EFA or EHD air cooling system 920. Electronic device 900 comprises a housing 916, or case, having a cover 910 that includes a display device 912. A portion of the front surface 921 of housing 916 has been cut away to reveal interior 922. Housing 916 of electronic device 900 may also comprise a top surface (not shown) that supports one or more input devices that may include, for example, a keyboard, touchpad and tracking device. Electronic device 900 further comprises electronic circuit 960 which generates heat in operation. A thermal management solution comprises a heat pipe 944 that transports heat from electronic circuit 960 to remote heat exchanger or heat sink device 942.

Device 920 is powered by high voltage power supply 930. Electronic device 900 may also comprise many other circuits, depending on its intended use; to simplify illustration of this second implementation, other components that may occupy interior area 922 of housing 920 have been omitted from FIG. 9.

With continued reference to FIG. 9, in operation, high voltage power supply 930 is operated to create a voltage difference between emitter electrodes and collector electrodes disposed in device 920, generating an ion flow or stream that moves ambient air toward the collector electrodes. The moving air leaves device 920 in the direction of arrow 902, traveling through heat sink 942 and through an exhaust grill or opening (not shown) in the rear surface 918 of housing 916, thereby dissipating heat accumulating in the air above and around heat sink 942. Note that the position of illustrated components, e.g., of power supply 930 relative to device 920 and electronic circuit 960, may vary from that shown in FIG. 9.

A controller 932 is connected to device 920 and may use sensor inputs to determine the state of the air cooling system, e.g., to determine a need for cleaning electrodes. Alternatively, the cleaning may be initiated by controller 932 on a timed or scheduled basis, on a system efficiency measurement basis or by other suitable methods of determining when to clean electrodes. For example, detection of electrode arcing or other electrode performance characteristics may be used to initiate movement of the cleaning mechanism to condition the electrode.

In some implementations, the cleaning or other conditioning is performed when the electrode is not in use. Alternatively, cleaning operations may be performed at timed intervals. In some cases, conditioning or cleaning may be initiated by controller 932 based upon one or more of an imposed voltage level, a measured electrical potential, determination of the presence of a level of contamination by optical means, by detection of an event or performance parameter, or other methods indicating a benefit from mechanically cleaning the electrode.

Some implementations of thermal management systems described herein employ EFA or EHD devices to motivate flow of a fluid, typically air, based on acceleration of ions generated as a result of corona discharge. Other implementations may employ other ion generation techniques and will nonetheless be understood in the descriptive context provided herein. Using heat transfer surfaces that may or may not be monolithic or integrated with collector electrodes, heat dissipated by electronics (e.g., microprocessors, graphics units, etc.) and/or other components can be transferred to the fluid flow and exhausted. Typically, when a thermal management system is integrated into an operational environment heat transfer paths (often implemented as heat pipes or using other technologies) are provided to transfer heat from where it is dissipated (or generated) to a location (or locations) within the enclosure where air flow motivated by an EFA or EHD device (or devices) flows over heat transfer surfaces.

In some implementations, an EFA or EHD air cooling system or other similar ion action device employing an electrode cleaning system may be integrated in an operational system such as a laptop or desktop computer, a projector or video display device, etc., other implementations may take the form of subassemblies. Various features may be used with different devices including EFA or EHD devices such as air movers, film separators, film treatment devices, air particulate cleaners, photocopy machines and cooling systems for electronic devices such as computers, laptops and handheld devices.

While the forgoing represents a description of various implementations of the invention, it is to be understood that the claims below recite the features of the present invention, and that other implementations, not specifically described hereinabove, fall within the scope of the present invention.

What is claimed is:

1. An apparatus comprising:

an electrohydrodynamic fluid accelerator;

an emitter electrode in spaced relation to one or more collector electrode surfaces, each of the emitter electrode and collector electrode surfaces susceptible to accumulation of detrimental material during operation of the electrohydrodynamic fluid accelerator; and a cleaning mechanism including respective cleaning surfaces positioned to frictionally engage the emitter electrode and at least a portion of the collector electrode surfaces, the cleaning mechanism operable to cause the respective cleaning surfaces thereof to travel along a longitudinal extent of the emitter electrode and, in tandem, over a major dimension of the collector electrode surfaces to thereby remove detrimental material from respective electrode surfaces.

2. The apparatus of claim 1, wherein the emitter electrode and the collector electrode surfaces are positioned relative to one another and energizable to motivate fluid flow along a fluid flow path, and wherein together, the emitter electrode and the collector electrode surfaces at least partially define the electrohydrodynamic fluid accelerator.

3. The apparatus of claim 2, further comprising:

at least one additional electrode surface disposed either upstream or downstream of the electrohydrodynamic fluid accelerator along the fluid flow path, wherein the cleaning mechanism includes at least one further cleaning surface to frictionally engage the at least one additional electrode surface and to travel over a major dimension thereof and in tandem along a longitudinal extent of the emitter electrode.

4. The apparatus of claim 1, wherein the emitter electrode and the collector electrode surfaces are operable as part of the electrohydrodynamic fluid accelerator.

5. The apparatus of claim 1, wherein the electrohydrodynamic fluid accelerator includes the emitter electrode and is energizable to motivate fluid flow along a fluid flow path, and wherein the collector electrode surfaces are disposed upstream of the electrohydrodynamic fluid accelerator along the fluid flow path and are operable as part of an electrostatic precipitator.

6. The apparatus of claim 5, wherein the emitter electrode and the collector electrode surfaces are operable as part of an electrostatic precipitator.

7. The apparatus of claim 5, further comprising a second emitter electrode operable as part of the electrostatic precipitator and wherein the cleaning mechanism including a respective cleaning surface to frictionally engage the second emitter electrode and wherein the cleaning mechanism is operable to travel in tandem along a longitudinal extent of both the first and the second emitter electrodes.

8. The apparatus of claim 1, wherein the emitter electrode is operable as part of one of the electrohydrodynamic fluid accelerator and an electrostatic precipitator, and wherein the collector electrode surfaces are operable as part of the other of the electrohydrodynamic fluid accelerator and the electrostatic precipitator.

9. The apparatus of claim 1, further comprising a secondary cleaning device positioned to frictionally engage a cleaning mechanism surface to remove detrimental material accumulated thereon.

10. The apparatus of claim 9, further comprising a receptacle positioned adjacent the cleaning device to receive the detrimental material removed by the secondary cleaning device.

11. The apparatus of claim 1, wherein a respective cleaning surface is angled relative to the respective electrode to impart a lateral component to movement of the respective electrode across the respective cleaning surface.

12. The apparatus of claim 1, wherein a respective cleaning surface is contoured to elastically deform the emitter electrode in a first direction during longitudinal travel and the cleaning mechanism is laterally moveable to elastically deform the emitter electrode in a second direction.

13. The apparatus of claim 1, wherein the respective cleaning surfaces are arranged to travel in tandem over the respective electrodes along divergent paths.

14. The apparatus of claim 1, wherein the collector electrode is configured as a guide rail for the cleaning mechanism during travel.

15. The apparatus of claim 1, wherein a respective cleaning surface in frictional engagement with the emitter electrode comprises an electrode conditioning material depositable on the electrode via movement of the cleaning mechanism.

16. The apparatus of claim 15, wherein the conditioning material is selected to at least partially mitigate the effects on the emitter electrode of at least one of erosion, corrosion, oxidation, silica adhesion and dendrite formation.

17. The apparatus of claim 15, wherein the conditioning material includes at least one of silver, palladium, platinum, manganese, nickel, zirconium, titanium, tungsten, aluminum, oxides or alloys thereof.

18. An apparatus comprising:

an electrostatic precipitator;

an emitter electrode in spaced relation to one or more collector electrodes, each of the emitter electrode and collector electrode susceptible to dendrite formation or other accumulation of detrimental material on a surface thereof during operation of the electrostatic precipitator; and a cleaning mechanism including respective cleaning surfaces positioned to frictionally engage at least a portion of the respective emitter electrode and collector electrode surfaces, the cleaning mechanism operable to cause the respective cleaning surfaces to travel along a longitudinal extent of the emitter electrode and, in tandem, over a major dimension of a collector electrode surface to thereby remove detrimental material from the respective electrode surfaces, wherein a first of the respective cleaning surfaces frictionally engages with the emitter electrode, but not the collector electrode, and wherein a second of the respective cleaning surfaces frictionally engages with the collector electrode, but not the emitter electrode.

19. The apparatus of claim 18, wherein the emitter electrode is operable as part of one of the electrostatic precipitator and an electrohydrodynamic fluid accelerator, and wherein the one or more collector electrodes are operable as part of the other of the electrostatic precipitator and the electrohydrodynamic fluid accelerator.

20. The apparatus of claim 18, further comprising a controller operable to initiate movement of one of the cleaning mechanism to thereby remove detrimental material from the electrode surfaces and wherein the controller is responsive to one of detection of an event, detection of arcing between the electrodes, and a change in measured device operating parameters.

21. An apparatus comprising:

an enclosure;

a thermal management assembly for use in convection cooling of one or more devices within the enclosure, the thermal management assembly defining a flow path for conveyance of air between portions of the enclosure over heat transfer surfaces positioned along the flow path to dissipate heat generated by the one or more devices, the thermal management assembly including an electrohydrodynamic (EHD) fluid accelerator including collector and emitter electrodes in spaced relation and energizable to motivate fluid flow along the flow path, wherein at least one of the electrodes is susceptible to accumulation of detrimental material during operation thereof; and a cleaning mechanism including respective cleaning surfaces positioned to frictionally engage at least a portion of the respective emitter electrode and collector electrode, the cleaning mechanism operable to cause the respective cleaning surfaces to travel along a longitudinal extent of the emitter electrode and, in tandem, over a major dimension of a collector electrode to thereby remove detrimental material from the respective electrodes.

22. The apparatus of claim 21, wherein the one or more devices includes one of a computing device, projector, copy machine, fax machine, printer, radio, audio or video recording device, audio or video playback device, communications device, charging device, power inverter, light source, medical device, home appliance, power tool, toy, game console, television, and video display device.

23. The apparatus of claim 1, wherein a first of the respective cleaning surfaces frictionally engages with the emitter electrode, but not the collector electrode, and wherein a second of the respective cleaning surfaces frictionally engages with the collector electrode, but not the emitter electrode.

* * * * *